US006830308B2

(12) United States Patent
Hamasaki et al.

(10) Patent No.: US 6,830,308 B2
(45) Date of Patent: Dec. 14, 2004

(54) INK-JET PRINTING APPARATUS AND ITS PRINTHEAD CONTROL METHOD

(75) Inventors: Yuji Hamasaki, Kanagawa (JP); Jiro Moriyama, Kanagawa (JP); Hidehiko Kanda, Kanagawa (JP); Yoshinori Nakagawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 81 days.

(21) Appl. No.: 10/282,178

(22) Filed: Oct. 29, 2002

(65) Prior Publication Data

US 2003/0081030 A1 May 1, 2003

(30) Foreign Application Priority Data

Oct. 30, 2001 (JP) ..... 2001-333352

(51) Int. Cl.[7] ..... B41J 29/38
(52) U.S. Cl. ..... 347/14; 347/17; 347/19
(58) Field of Search ..... 347/14, 19, 17, 347/10, 56, 65, 57, 62

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,774,137 A | * | 6/1998 | Yoshida | 347/14 |
| 5,805,180 A | | 9/1998 | Ebisawa et al. | 347/23 |
| 6,079,809 A | | 6/2000 | Yaegashi et al. | 347/35 |
| 6,471,322 B2 | | 10/2002 | Kanda et al. | 347/15 |
| 6,644,770 B1 | * | 11/2003 | Niimura et al. | 347/14 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Lamson D Nguyen
(74) *Attorney, Agent, or Firm*—Fitzpatrick, Cella, Harper & Scinto

(57) ABSTRACT

An in-jet printing apparatus having a temperature detection device for outputting a signal in correspondence with a temperature, performs printing by using an ink-jet printhead which performs printing on a recording medium by discharging ink. A flag indicating whether acquisition of the temperature information is necessary or not is set, and the temperature information is obtained in accordance with the status of the flag, after the power on of the apparatus. The obtained temperature information is stored into a nonvolatile storage device. The temperature information can be obtained at appropriate timing in accordance with necessity, even if the power is interrupted during the operation. Thus a high-quality printed output can be obtained by performing a stable printing operation.

20 Claims, 10 Drawing Sheets

INK-JET PRINTING APPARATUS AND ITS PRINTHEAD CONTROL METHOD

FIELD OF THE INVENTION

The present invention relates to an ink-jet printing apparatus and its printhead control method, and more particularly, to an ink-jet printing apparatus which performs printing on a recording medium by using an ink-jet printhead which performs printing by discharging ink, and having a temperature detection device which outputs a signal in correspondence with a temperature, and to acquisition of temperature information used for printhead control.

BACKGROUND OF THE INVENTION

Printers which perform printing based on information of desired characters, images and the like on sheet-type print media such as print sheets and films are widely used as information output apparatuses of word processors, personal computers, facsimile machines.

Various printing methods for the printers are known, and in recent years, the ink-jet method especially attracts attention. In the ink-jet printing method, printing without contact with recording medium such as print sheet is possible, and color printing can be easily made, and further, printing with suppressed noise can be performed. The ink-jet printing is generally used as a serial printing method of performing printing by using a printhead which discharges ink in correspondence with desired print information while scan-moving the printhead in a direction orthogonal to conveyance direction of recording medium such as print sheet. This method is widely used since it enables a low-price and compact printing apparatus.

Conventionally, in the ink-jet printing apparatus, ink viscosity is influenced by temperature. To maintain a constant amount of ink to be discharged regardless of temperature, a temperature detection device is provided on a circuit board inside the apparatus main body or on a circuit board of the printhead. An environmental temperature (apparatus internal temperature) is obtained by various computations and correction processing on temperature information obtained by the temperature detection device. Then, energy to be applied to the ink-jet printhead is determined based on the obtained environmental temperature, by e.g. referring to a predetermined energy application table, and the ink-jet printhead is driven.

The temperature information as a basis for temperature control is obtained immediately before driving of the ink-jet printhead or when the printing apparatus is in a predetermined status. Further, generally, the results of various computations and corrections are temporarily stored in volatile storage means, and the obtained environmental temperature is not stored.

However, in the conventional arrangement where the temperature information is obtained at predetermined timing and the results of computations and corrections are temporarily stored in the storage means, if the temperature information is obtained in a state where the values of computations and corrections are lost, e.g., the power of the ink-jet printing apparatus is turned off then again turned on and printing is started, computations and corrections cannot be correctly performed. In such case, the obtained environmental temperature is different from an actual temperature.

In this case where the obtained environmental temperature is different from the actual temperature, the energy application table used for printhead driving is not appropriate to the actual temperature. Accordingly, ink discharge from the printhead is unstable, which degrades printing quality.

SUMMARY OF THE INVENTION

The present invention has its object to provide an ink-jet printing apparatus which obtains temperature information at appropriate timing in accordance with necessity, even if the power is interrupted during the operation, and produces a high-quality printed output by a stable printing operation.

According to the present invention, the foregoing object is attained by providing an ink-jet printing apparatus which performs printing on a recording medium by using an ink-jet printhead which performs printing by discharging ink, comprising: a temperature detection device that outputs a signal in correspondence with a temperature; temperature information acquisition means for obtaining temperature information based on the signal outputted from the temperature detection device; nonvolatile storage means for storing the temperature information obtained by the temperature information acquisition means; flag setting means for setting a flag indicating whether acquisition of the temperature information is necessary or not; and control means for checking a status of the flag after a power of the apparatus is turned on, and for controlling the acquisition of the temperature information in accordance with the status of the flag.

Another object of the present invention is to provide a printhead control method in the ink-jet printing apparatus for obtaining the temperature information at appropriate timing in accordance with necessity, even if the power is interrupted during the operation, and producing a high-quality printed output by a stable printing operation.

The foregoing object is attained by providing a printhead control method in an ink-jet printing apparatus which has a temperature detection device to output a signal in correspondence with a temperature and which performs printing on a recording medium by using an ink-jet printhead which performs printing by discharging ink, the method comprising: a temperature information acquisition step of obtaining temperature information based on the signal outputted from the temperature detection device; a storage step of storing the temperature information obtained at the temperature information acquisition step; a flag setting step of setting a flag indicating whether acquisition of the temperature information is necessary or not; and a control step of checking a status of the flag after a power of the apparatus is turned on, and controlling the acquisition of the temperature information in accordance with the status of the flag.

That is, in accordance with the present invention, in an ink-jet printing apparatus which has a temperature detection device to output a signal in correspondence with a temperature and which uses a printhead to perform printing by discharging ink, temperature information is obtained based on the signal outputted from the temperature detection device, then the obtained temperature information is stored into nonvolatile storage means, a flag indicating whether acquisition of the temperature information is necessary or not is set, a status of the flag is checked after a power of the apparatus is turned on, an the acquisition of the temperature information is controlled in accordance with the status of the flag.

In this arrangement, if a flag indicating whether acquisition of the temperature information is necessary is set e.g. based on the elapsed time since the beginning of status where the apparatus does not perform printing, the temperature information is obtained after a power of the apparatus is turned on, and the stored information is updated.

Accordingly, the temperature information can be obtained at appropriate timing in accordance with necessity, even if the power is interrupted during the operation, and a high-quality printed output can be produced by performing a stable printing operation.

Preferably, the temperature flag setting means sets a flag indicating that the acquisition of the temperature information is necessary, if elapsed time since the beginning of a status where the printing apparatus does not perform printing becomes predetermined time.

More preferably, if the elapsed time since the beginning of a status where said printing apparatus does not perform printing becomes first time, the flag setting means sets a flag indicating that acquisition of the temperature information is necessary, and if the elapsed time since the beginning of the status where the printing apparatus does not perform printing becomes second time which is longer than the first time, the control means controls to obtain the temperature information.

If the printhead is capped, the flag setting means may determine that the printing apparatus is in the status where the apparatus does not perform printing.

Preferably, the temperature information acquisition means obtains an environmental temperature by predetermined computation based on the signal outputted from the temperature detection device.

In this case, the temperature information acquisition means uses a correction value for the signal outputted from the temperature detection device in the predetermined computation.

The correction value may be obtained from a profile of the signal outputted from the temperature detection device.

If the temperature information is not stored in the storage means, the control means may control to obtain the temperature information.

The temperature detection device may be provided in the printing apparatus main body or in the printhead.

The temperature detection device may be a thermistor.

Preferably, the printhead discharges ink by utilizing thermal energy, and includes thermal energy transducers for generating thermal energy to be applied to the ink.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF PREFERRED EMBODIMENTS

Figure 1:
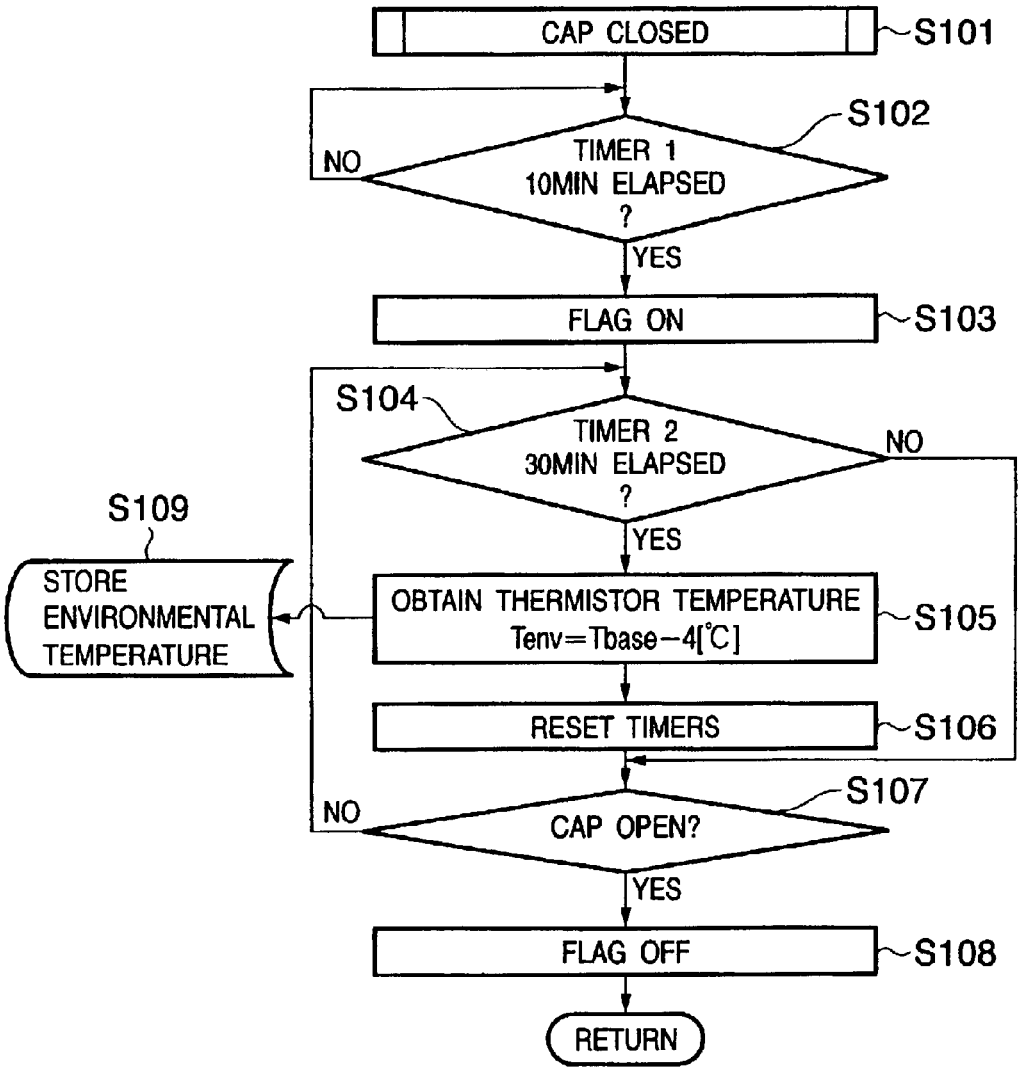
FIG. 1 is a flowchart showing temperature information acquisition processing according to an embodiment of the present invention.

Preferred embodiments of the present invention will now be described in detail in accordance with the accompanying drawings. In the following embodiments, a printer is used as the printing apparatus based on the ink-jet printing method. Note that corresponding elements and parts through the respective drawings have the same reference numerals.

In this specification, "print" is not only to form significant information such as characters and graphics, but also to form, e.g., images, figures, and patterns on print media in a broad sense, regardless of whether the information formed is significant or insignificant or whether the information formed is visualized so that a human can visually perceive it, or to process print media.

"Print media" are any media capable of receiving ink, such as cloth, plastic films, metal plates, glass, ceramics, wood, and leather, as well as paper sheets used in common printing apparatuses.

Furthermore, "ink" (to be also referred to as "liquid" hereinafter) should be broadly interpreted like the definition of "print" described above. That is, ink is liquid which is applied onto a recording medium and thereby can be used to form images, figures, and patterns, to process the recording medium, or to process ink (e.g., to solidify or insolubilize a colorant in ink applied to a recording medium).

(Overall Construction)

Figure 3:
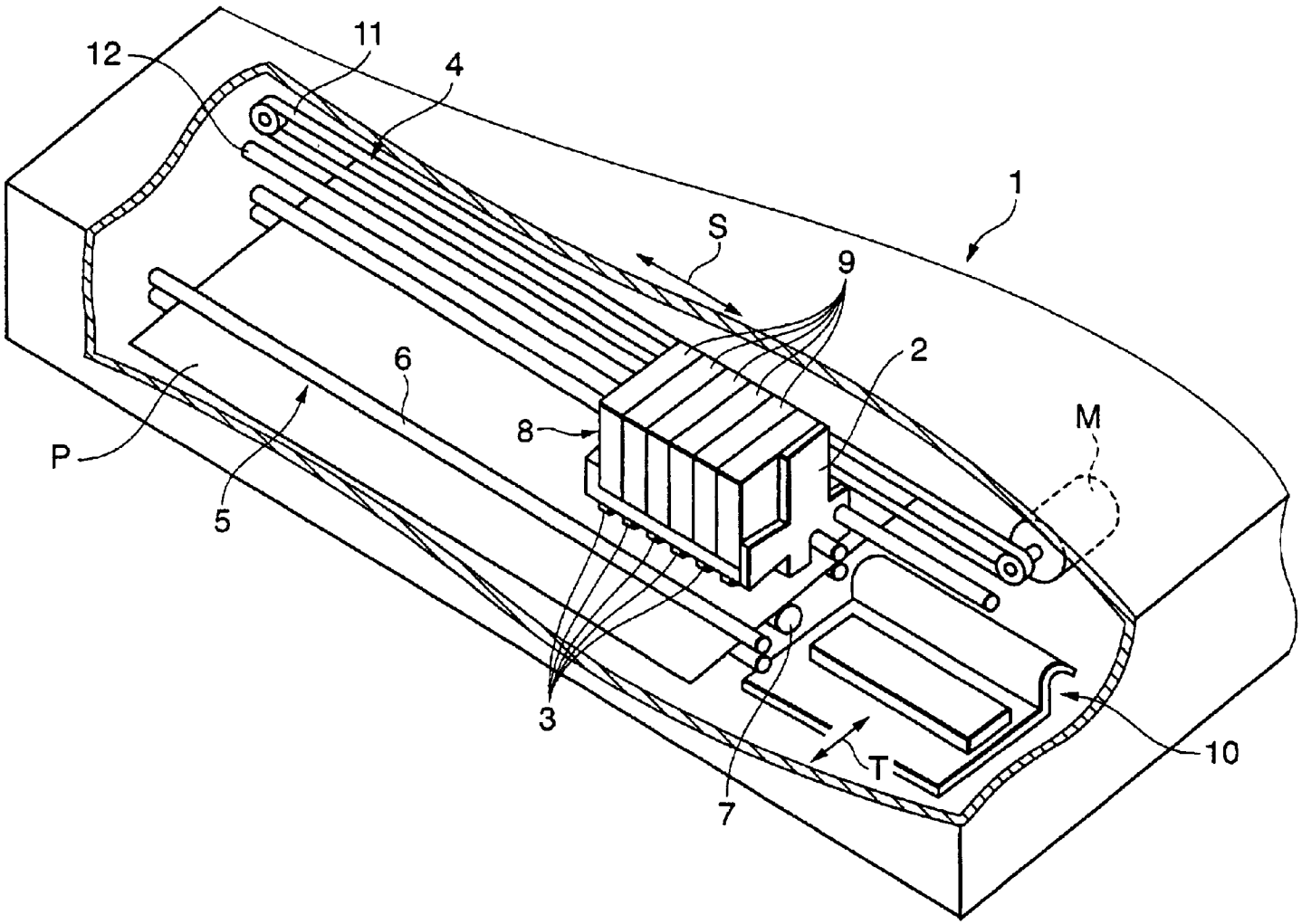
FIG. 3 is a partial-cutaway perspective view showing the structure of ink-jet printing apparatus as the embodiment of the present invention.
Figure 4:
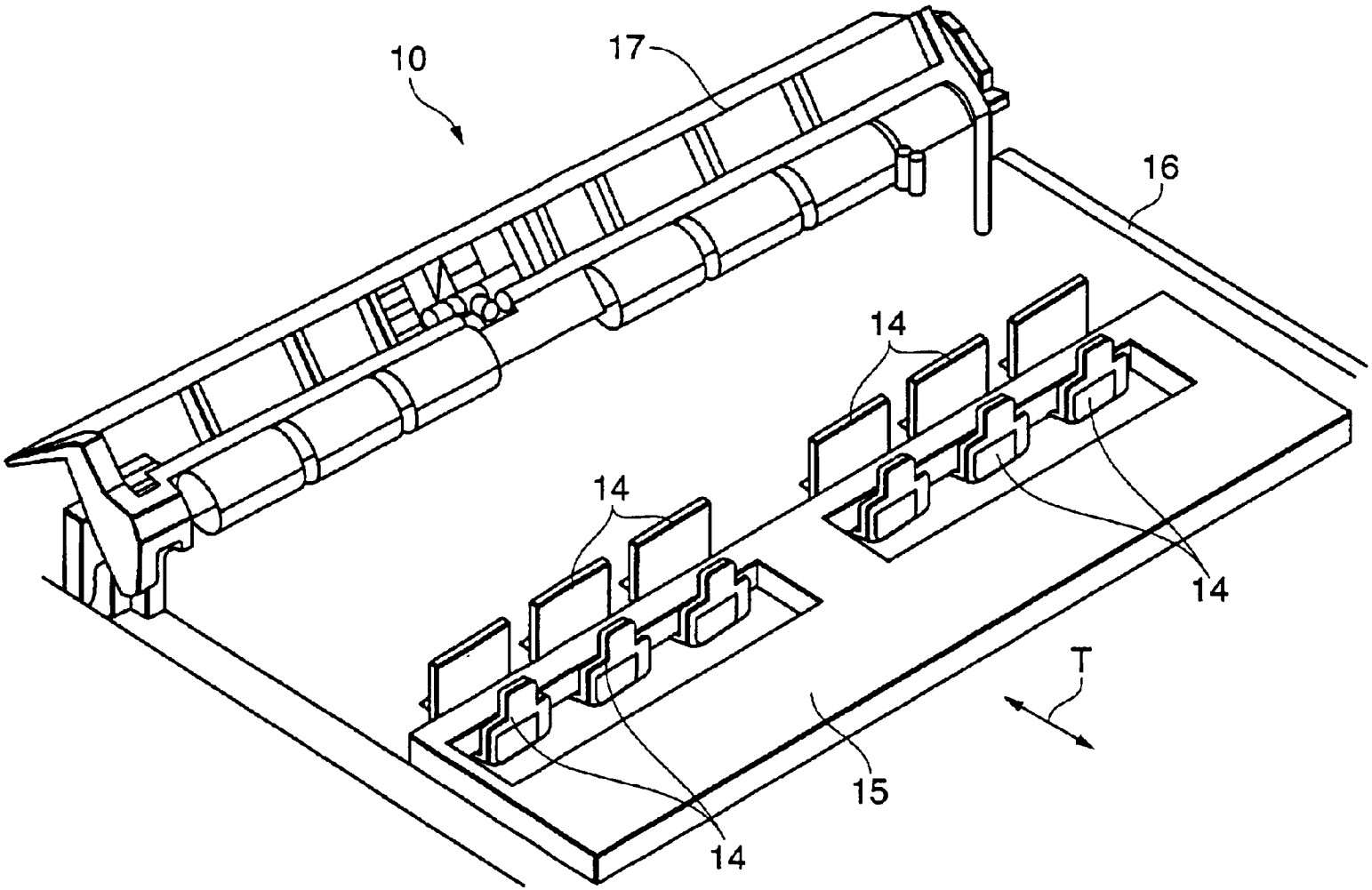
FIG. 4 is a perspective view of a cleaning device of the ink-jet printing apparatus in FIG. 3.

The construction of the ink-jet printing apparatus to which the present invention is applied will be described with reference to FIGS. 3 and 4. FIG. 3 is a partial-cutaway perspective view showing the structure of the ink-jet printing apparatus as the embodiment of the present invention. FIG. 4 is a perspective view of a cleaning device of the ink-jet printing apparatus in FIG. 3, viewed from an upper position.

In FIGS. 3 and 4, the ink-jet printing apparatus 1 has a drive motor M as a driving source, a carriage 2 on which an ink-jet printhead 3 is mounted, a transmission mechanism 4 which scan-moves the carriage 2 by the drive motor M, a paper feed mechanism (paper conveyance mechanism) 5 which conveys (feeds) a print sheet P as a recording medium, and a cleaning device 10 which cleans (sweeps) an ink discharge surface of the printhead 3 as discharge recovery processing. In the ink-jet printing apparatus 1, the print sheet P is fed into the apparatus by paper-feed rollers 6 of the paper feed mechanism 5, and predetermined printing is performed by the printhead 3 on the print sheet P, on a platen 7.

In FIG. 3, the carriage 2 is connected to a part of drive belt 11 of the transmission mechanism 4 which transmits the driving force of the drive motor M, and is slidably guided along two parallel (or single) guide shafts 12 in a main scanning direction. The carriage 2 is driven by the drive motor M. Accordingly, the carriage 2 scan-moves along the guide shafts 12 in arrow S directions by forward and reversed rotation of the drive motor M.

In the ink-jet printing apparatus 1, the platen 7 is provided to be opposite to the ink discharge surface of the printhead 3 having discharge orifices. When the carriage 2 carrying the printhead 3 is scan-moved by the driving force of the carriage drive motor M, a print signal is applied to the printhead 3 to discharge ink, thereby printing is performed over the width of the print sheet P as a recording medium conveyed onto the platen 7.

Further, in the ink-jet printing apparatus 1 having the above construction, a recovery device for recovery from poor discharge status of the printhead 3 is provided in a desired position without the range of scan-movement of the carriage 2 carrying the printhead 3 as an printing operation (without a printing area). Generally, the recovery device has a cap member to cap the ink discharge surface of the printhead 3. As discharge recovery processing, the device forcibly discharges ink from the discharge orifices by suction means (suction pump or the like) of the device in cooperation with capping of the ink discharge surface by the cap member, thereby removes viscosity-increased ink or bubbles in ink channels of the printhead 3. Further, when printing is not performed, the recovery device caps the printhead thereby protects the printhead and prevents drying of ink.

In FIGS. 3 and 4, the cleaning device 10 can be provided together with the recovery device, or in a position corresponding to a home position of the printhead where the recovery device is provided. The cleaning device 10 has blades 14 as wiping members for sweeping the ink discharge surface of the printhead 3, a blade holder 15 which supports the blades 14 and which is movable in arrow T directions along a guide member, an actuation mechanism 16 which actuates scan-movement of the blade holder 15, and a rotatable blade cleaner 17 which cleans the blades 14.

The blades 14 to clean the ink discharge surface of the printhead 3 are formed of elastic material such as rubber, and held at one end of the blade holder 15 in the form as shown in FIG. 4. The blades 14 are actuated by appropriate motor and transmission mechanism as in the case of the above-described recovery device, thereby pressed against the ink discharge surface of the printhead 3 and sweep the ink discharge surface.

Accordingly, after printing by the printhead 3, the printhead 3 is set to the home position, and the cleaning device 10 is relatively moved to press-slide the blades 14 against the ink discharge surface. This operation wipes ink or the like attached to the ink discharge surface, condensation, moisture, dust such as paper powder and the like on the ink discharge surface, and thus cleans the ink discharge surface of the printhead 3.

The printhead 3 is attachable to the carriage 2. An ink tank 9 is attachable to the printhead 3. The printhead 3 is supplied with ink from the ink tank 9. In this case, junction surfaces of the carriage 2 and the printhead 3 are appropriately brought into contact, and required electrical connection can be maintained.

The printhead 3 of the present embodiment is an ink-jet printhead which discharges ink selectively from plural discharge orifices by application of energy in correspondence with a print signal. Further, the printhead 3 has electrothermal transducers to generate thermal energy as ink-jet printing means for discharging ink by utilizing thermal energy. Further, as a pressure change occurs due to growth and shrinkage of bubble by film boiling caused by the thermal energy applied by the electrothermal transducers, the printhead 3 discharges ink by utilizing the pressure change, thus performs printing. The electrothermal transducers are provided in correspondence with the respective discharge orifices. When a pulse voltage is applied to an electrothermal transducer in correspondence with a print signal, ink is discharged from a corresponding discharge orifice.

In the present embodiment, energy application tables are provided in accordance with environmental temperature, ink-jet printhead temperature, difference in resistance depending on individual electrothermal transducers, and the like, and stored in the ink-jet printing apparatus. An appropriate table is selected based on these values.

(Printhead)

Figure 8:
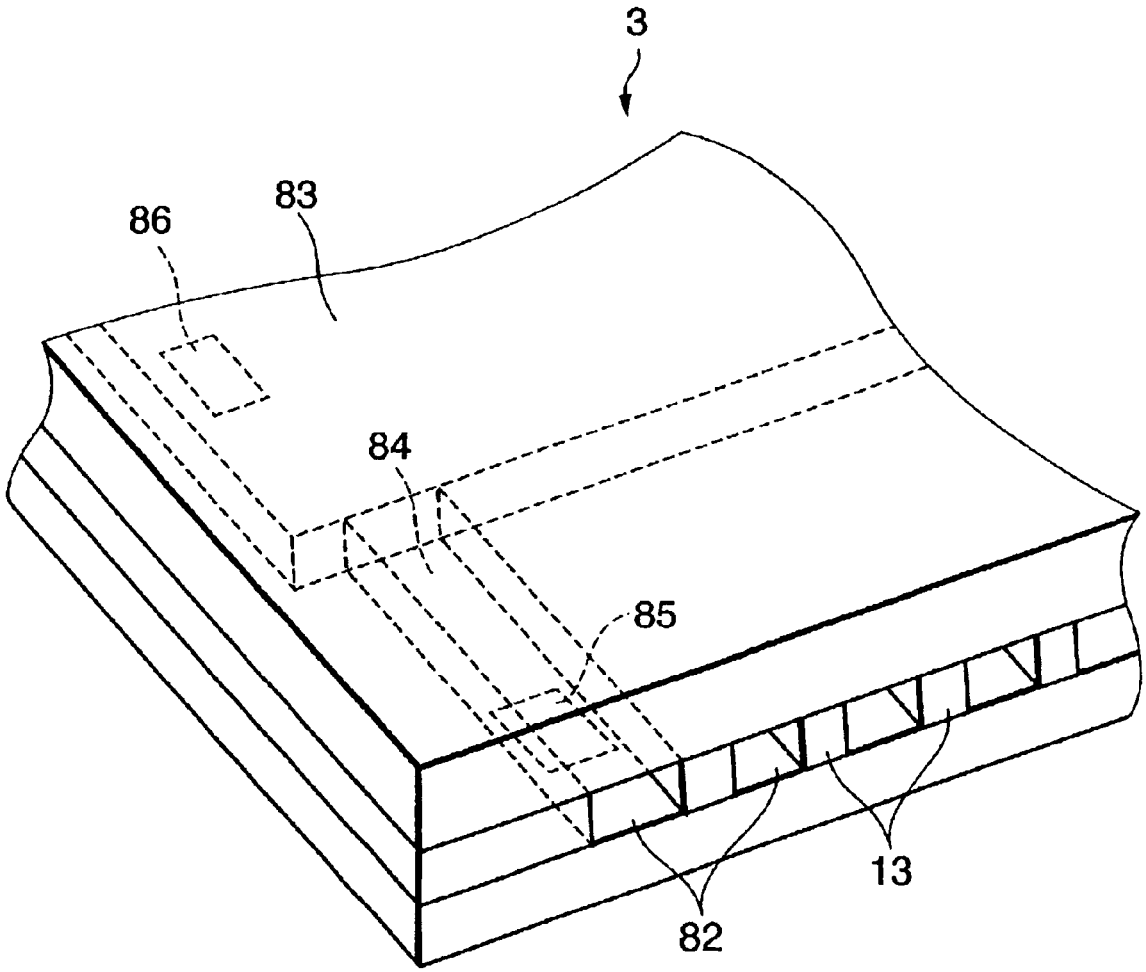
FIG. 8 is a partial exploded view showing the arrangement of respective nozzles of the ink-jet printhead in FIG. 5.

FIG. 8 is a partial exploded view showing the arrangement of respective nozzles (one array of discharge orifices) of the ink-jet printhead 3. In FIG. 8, in an ink discharge surface 13 facing the recording medium (print sheet or the like) P with a predetermined clearance (of e.g. about 0.3 to 2.0 mm), plural discharge orifices 82 are formed with a predetermined pitch, and electrothermal transducers (heat generating resistors or the like) 85 are provided along wall surfaces of respective ink channels 84 connecting a common ink chamber 83 to the respective discharge orifices 82. The printhead 3 is guided in positional relation such that the discharge orifices 82 are arrayed in a direction orthogonal to the main scanning direction (in the present embodiment where the printhead 3 is mounted on the carriage 2, a moving direction S of the carriage 2).

In correspondence with an image signal or discharge signal, the printhead 3 drives (applies a pulse voltage to) corresponding electrothermal transducers 85, so as to cause film boiling of ink in the ink channels 54 and discharge ink droplets from the discharge orifices 82 by pressure due to the film boiling. Further, an ink temperature-retaining electrothermal transducer 86 to keep the temperature of ink is provided inside the common ink chamber 83. The ink temperature-retaining electrothermal transducer 86 is driven (by application of pulse voltage) in correspondence with an external temperature environment or the like, so as to keep the ink temperature and maintain the stability of ink discharging.

Figure 5:
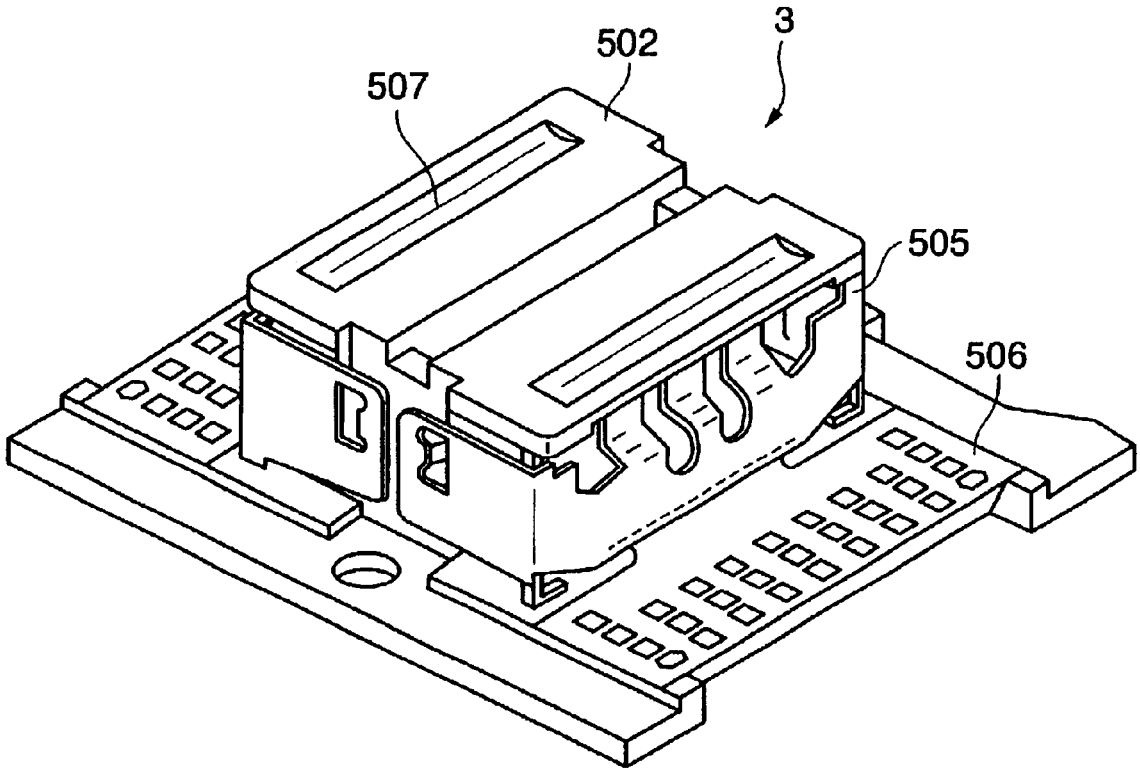
FIG. 5 is a perspective view showing the structure of ink-jet printhead in FIG. 3.

FIG. 5 is a perspective view of the ink-jet printhead 3 mounted on the ink-jet printing apparatus of the present embodiment. The ink-jet printhead 3 has a resin member 502, a spring member 506, a wiring board 506, an ink-discharge nozzle array 507 and information storage means (not shown). The ink-discharge nozzle array 507 is provided in the resin member 502. The wiring board 506 and a silicone substrate, (not shown) holding the electrothermal transducers, connected to the wiring board 506, are dynamically pressed against each other by the spring member 505, such that the respective ink discharge nozzles and the corresponding electrothermal transducers are aligned with each other in high precision and the nozzles and the transducers are brought into tight contact.

Further, a clearance portion is airtightly sealed by coating of adhesive. Resin around the ink-discharge nozzle array 507 is processed to have water-repellency such that factors to cause ink discharge failure such as unnecessary ink and dust are not attached to the ink-discharge nozzles. Further, a hydrophilic member is provided in a position appropriately away from the ink-discharge nozzle array 507, so as to trap waste remaining on the ink discharge nozzle surface.

Further, ink is discharged by electrical connection between the electrical contact provided on the contact pads provided on the wiring substrate 506 and the carriage, and application of electric signal appropriate to main scanning of the ink-jet printhead, thus desired printing is performed.

The ink-jet printhead of thermal printing type which uses resin and spring has been described as an example, but the present invention is applicable to a piezoelectric device type ink-jet printhead, an ink-jet printhead having ink-discharge nozzles formed by photolithographic process, and the like, and its advantages are not impaired in all the types of ink-jet printheads.

(Control Construction)

Figure 9:
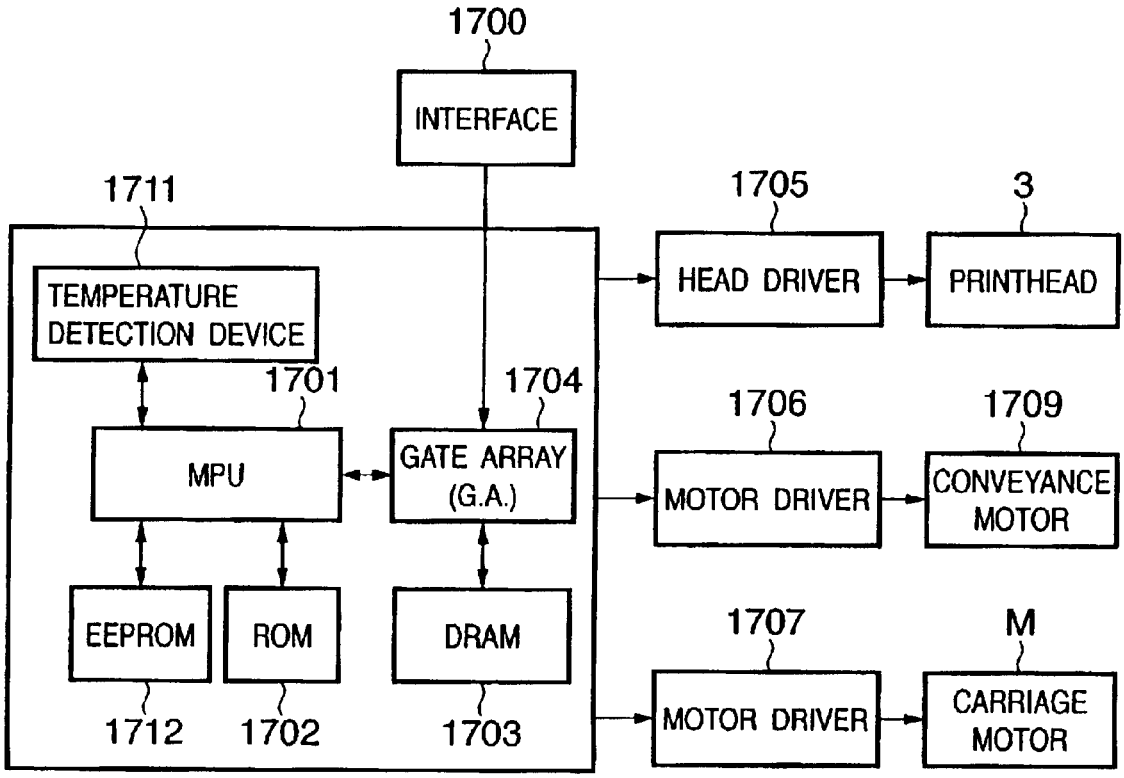
FIG. 9 is a block diagram showing the construction of control circuit of the ink-jet printing apparatus.

FIG. 9 is a block diagram showing the construction of control circuit of the ink-jet printing apparatus of the present embodiment. In FIG. 9 showing the control circuit, reference numeral 1700 denotes an interface for inputting a print signal; 1701, an MPU; 1702, a ROM for storing a control program executed by the MPU 1701; and 1703, a DRAM for storing various data (the print signal, print data supplied to the printhead and the like). Numeral 1704 denotes a gate array (G. A.) for performing supply control of print data to the printhead 3. The gate array 1704 also performs data-transfer control among the interface 1700, the MPU 1701, and the RAM 1703.

Alphabet M denotes a carriage motor for conveyance of the printhead 3; 1709, a conveyance motor for conveying the recording medium; 1705, a head driver for driving the printhead 3; and 1706 and 1707, motor drivers for driving the conveyance motor 1709 and the carriage motor 1710. Further, numeral 1711 denotes a temperature detection device disposed at the outside of the printhead within the printing apparatus for detecting an environmental temperature; and 1712, a an EEPROM as electrically rewritable non-volatile storage means for storing data on temperature information.

The operation of the above control arrangement will be described below. When a print signal is inputted into the interface 1700, the print signal is converted into print data for printing between the gate array 1704 and the MPU 1701. The motor drivers 1706 and 1707 are driven, and the printhead 3 is driven in accordance with the print data supplied to the head driver 1705, thus printing is performed.

In this construction, the control program executed by the MPU 1701 is stored in the ROM 1702, however, the control program may be stored into an erasable/writable storage medium such as an EEPROM such that the control program can be changed from a host computer connected to the ink-jet printing apparatus.

Figure 10:
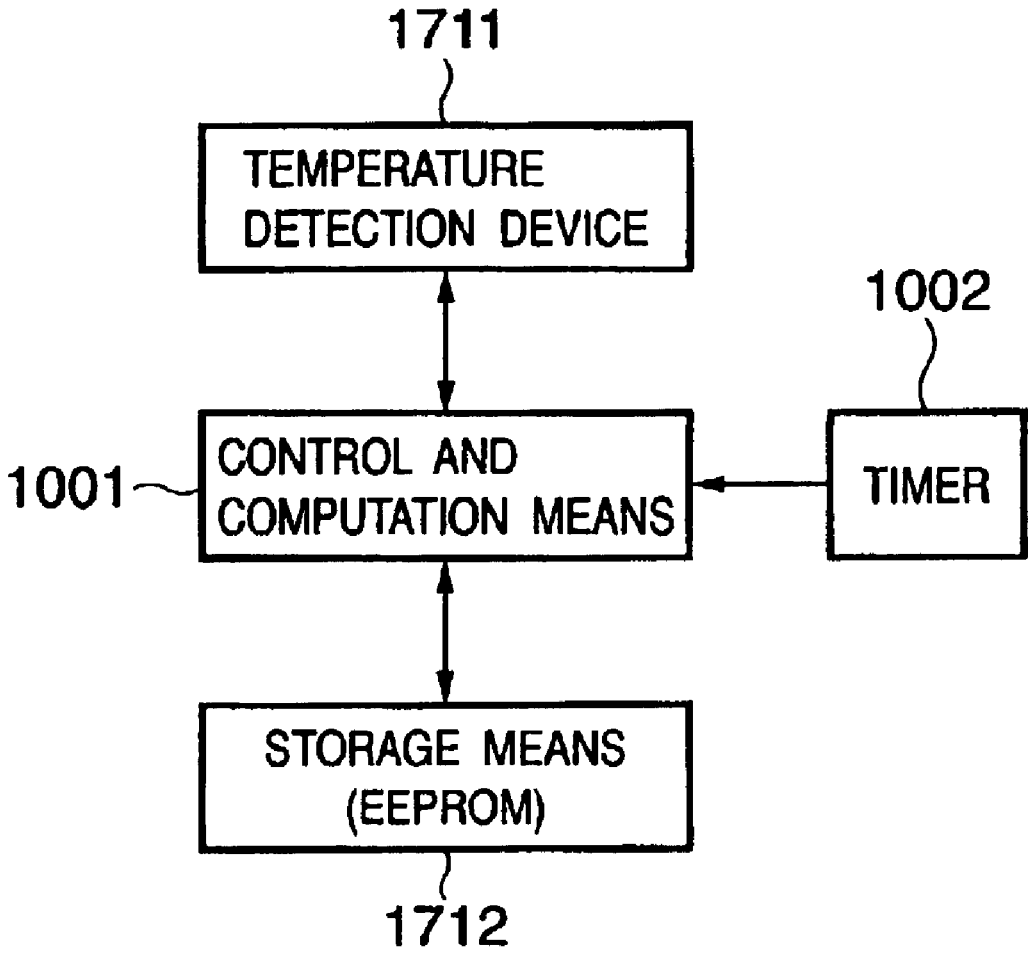
FIG. 10 is a functional block diagram showing the functional construction related to temperature information according to the embodiment.

FIG. 10 is a functional block diagram showing the functional construction related to temperature information according to the present embodiment. If it is determined from time counted by a timer 1002 that an elapsed time since the beginning of predetermined status has become predetermined time, data measured by the temperature detection device 1711 such as a thermistor is read by control and computation means 1001. Further, the control and computation means 1001 obtains the environmental temperature by using correction data stored in the rewritable non-volatile storage means 1712 such as an EEPROM, and stores the data read from the temperature detection device 1711, data on the time measured by the timer 1002 and the data on the environmental temperature into the storage means 1712.

Note that among the functional blocks in FIG. 10, the temperature detection device 1711 and the storage means 1712 are the same as those in FIG. 9. The control and computation means 1001 is realized by execution of the program stored in the ROM 1702 by the MPU 1701 in FIG. 9. The timer 1002 may be a timer inside the MPU 1701 or another timer. Further, in the storage means 1712, it is preferable that the respective data are stored in different areas. In this case, the area may be divided in software, or a hardware module structure may be constructed by plural memories.

In the present embodiment, the ink-jet printing apparatus has means 301 for storing information on time, temperature, determination as to whether or not temperature acquisition is necessary, and the like, for enabling storage, reading and rewriting of a value read from temperature detection means 302 such as a temperature thermistor and a value of time count means 303. Further, storage, reading and rewriting are possible in correction value storage means 304 storing the above obtained values and rough value computation correction means 305.

(Environmental Temperature Acquisition Operation)

Next, the operation of temperature acquisition according to the present embodiment will be described with reference to the flowcharts in FIGS. 1 and 2. FIG. 1 shows the temperature acquisition when the ink-jet printing apparatus is operating; and FIG. 2, the temperature acquisition when the power of the apparatus is turned ON.

First, the temperature acquisition when the ink-jet printing apparatus is operating will be described with reference to FIG. 1. In this embodiment, when the printhead is capped, it is determined that the ink-jet printing apparatus has went into an undriven status where it does not perform printing, and time counting by two timers is started (step S101) in response to the capping of the printhead.

It is determined whether or not the time counted by the first timer, i.e., the elapsed time since the beginning of the undriven status of the ink-jet printing apparatus, has become first predetermined time (10 minutes in this embodiment) or longer (step S102). The first timer is checked until the first predetermined time has elapsed. Then, when the time measured by the first timer has become the first predetermined time, a flag indicating whether or not temperature information acquisition is necessary is tuned ON.

Next, it is determined whether or not the time counted by the second timer has become second predetermined time (30 minutes in this embodiment) or longer (step S104). If the time counted by the second timer is equal to or longer than the second predetermined time, temperature information acquisition processing is performed (step S105). In the present embodiment, a thermistor is employed as the temperature detection device. Assuming that the temperature measured by the thermistor is Tbase, an environmental temperature Tenv is obtained by correction by Tenv=Tbase−4(C.°).

Then, the obtained environmental temperature is stored (step S109). At this time, the two timers are reset (step S106). Next, it is determined whether or not the status of the ink-jet printing apparatus has changed, based on whether or not the cap of the printhead is removed (step S107). If the cap of the printhead is removed, it is determined that the ink-jet printing apparatus performs printing. Then the flag of temperature information acquisition is turned OFF (step S108) for performing printhead discharge control based on the currently-stored environmental temperature, and the process ends.

Note that if it is determined at step S107 that the cap of the printhead is not removed, the process returns to step S104, at which it is determined whether or not the time counted by the second timer is equal to or longer than the second predetermined time.

Further, if it is determined at step S104 that the time counted by the second timer is shorter than the second predetermined time, the process proceeds to step S107 without execution of the temperature information acquisition. As will be described later, in the present embodiment, if the elapsed time since the beginning of the undriven status of the printing apparatus is shorter than 30 minutes, the temperature information acquisition is not performed, since the detected temperature of the temperature information acquisition device is considered unstable.

Figure 6:
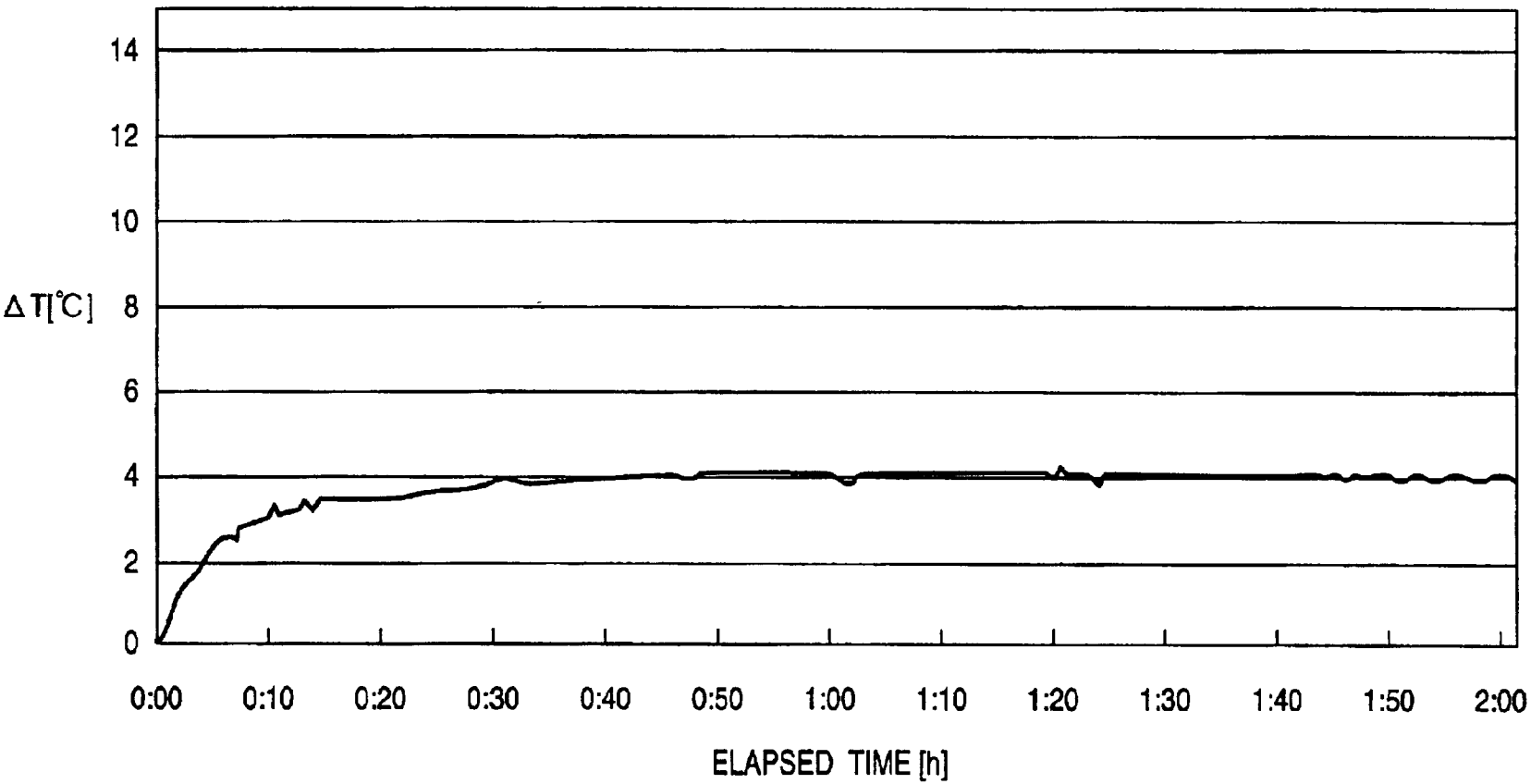
FIG. 6 is a graph showing change of temperature measured by a temperature detection device according to the embodiment.

FIG. 6 is a graph showing change of temperature difference ΔT (C.°) between the environmental temperature and the temperature measured by the temperature detection device (thermistor) when the power of the ink-jet printing apparatus of the present embodiment is ON and the apparatus is in the undriven status. As shown in the graph, the temperature difference after 30 minutes from the power-up point is about 4°C., and it is approximately constant thereafter. In the present embodiment, at the above-described temperature information acquisition step S105, "4" is used as a correction value for obtaining the environmental temperature based on the actually-measured data.

Note that the time counted by the second timer and the correction value for obtaining the environmental temperature are not limited to the above values, and these values may be properly set in accordance with the profile of the detected temperature.

Further, note that the difference between the temperature measured by the temperature detection device and the environmental temperature differs depending on the construction of ink-jet printing apparatus, the temperature detection device or its location. However, the environmental temperature can be precisely obtained in each apparatus by using the correction value based on the actually-measured data.

In this manner, upon downsizing of the ink-jet printing apparatus, the electric circuit board and the like, even if the temperature detection device is positioned around a device which generates heats by electrification, the environmental temperature can be obtained with high precision. Thus, the freedom regarding arrangement of the temperature detection device increases, and the invention is advantageous to downsizing, cost reduction and the like of the apparatus.

Figure 7:
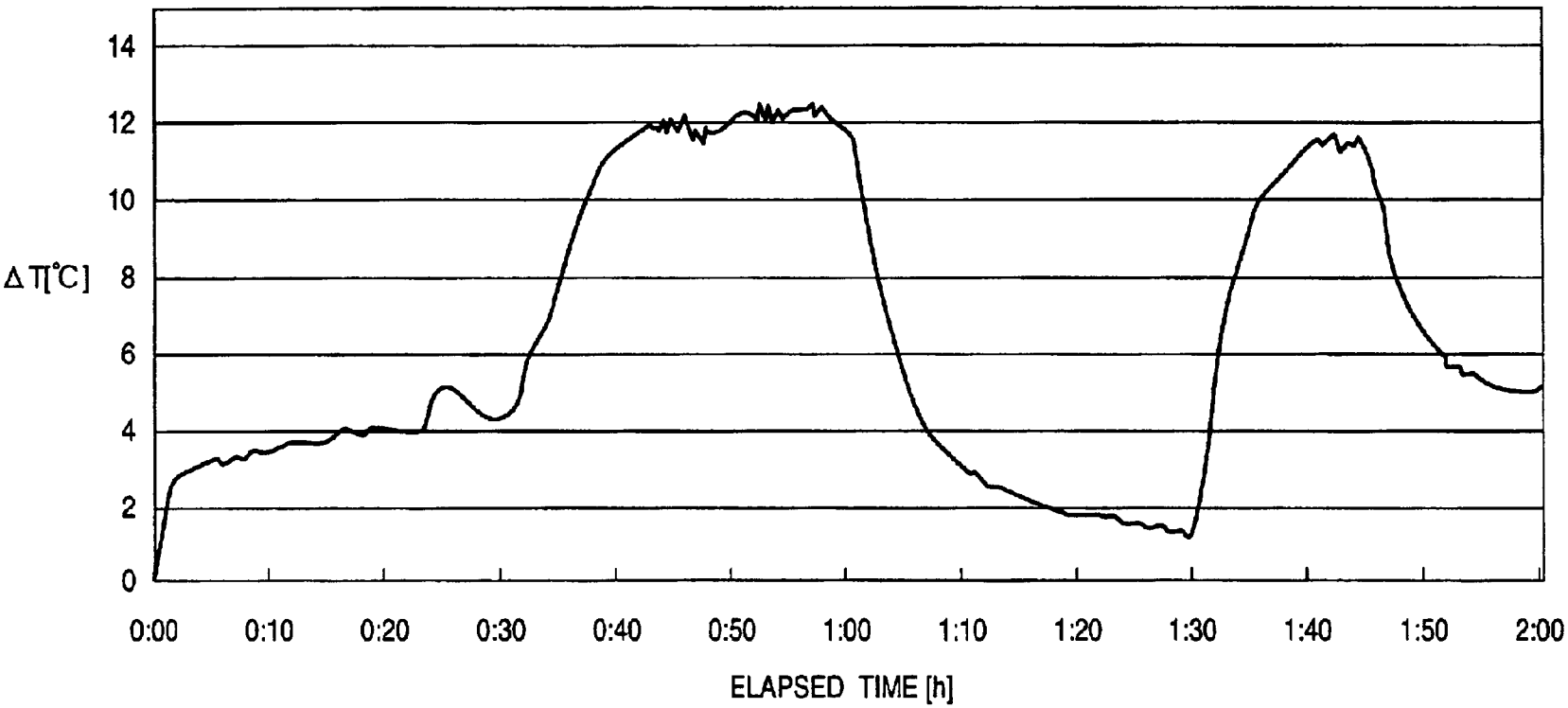
FIG. 7 is a graph showing the change of temperature when the ink-jet printing apparatus of the embodiment is driven.

FIG. 7 is a graph showing the change in the temperature measured by the temperature detection device when the ink-jet printing apparatus of the present embodiment is in the undriven status and the driven status. As shown in the graph, the temperature rise when the ink-jet printing apparatus is driven is about 12°, and it becomes to approximately initial temperature in about 30 minutes from the beginning of the undriven status. In the present embodiment, at the above-described temperature information acquisition process step 104, if the elapsed time since the beginning of the undriven status is equal to or longer than 30 minutes, the temperature information is obtained based on the temperature fall time of about 30 minutes.

The temperature rise and fall due to driving have profiles respectively unique to the respective apparatus models. If the above-described elapsed time for temperature information acquisition is previously determined by previously obtaining the temperature fall time based on such actually-measured data, the environmental temperature can be further precisely obtained.

Figure 2:
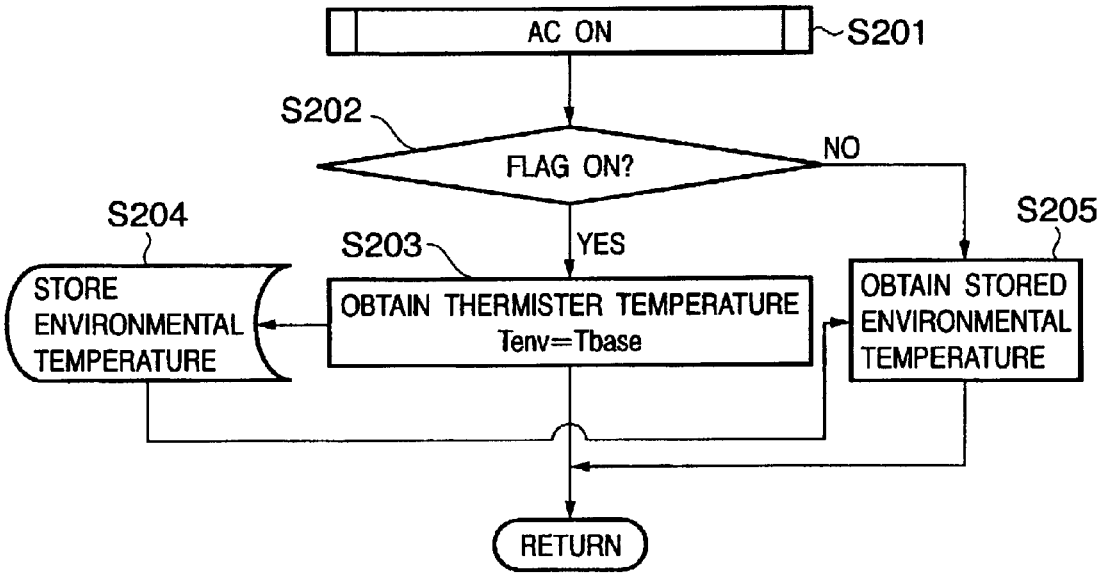
FIG. 2 is a flowchart showing processing upon power-up of the apparatus according to the embodiment.

FIG. 2 is a flowchart showing processing upon power-up of the ink-jet printing apparatus according to the present embodiment.

At step S201, when the power of the ink-jet printing apparatus is turned on, it is determined whether or not the flag, that is turned ON at step S103 and turned OFF at step S108 in the flowchart of FIG. 1, is ON (step S202).

If it is determined that the flag is ON, as the elapsed time since the beginning of the undriven status is 10 minutes or longer, the temperature information is obtained by the temperature detection device (thermistor) and then the environmental temperature is obtained (step S203), and the obtained environmental temperature is stored (step S204). Note that at step S203, the temperature measured by the temperature detection device is not corrected and used as the environmental temperature. As the elapsed time since the beginning of the undriven status is 10 minutes or longer and the power has been turned off, the difference between the measured temperature and the environmental temperature is very small as understood from the graph of FIG. 7, accordingly, the measured temperature is used as the environmental temperature without correction.

On the other hand, if the flag is OFF at step S202, the stored environmental temperature is read out (step S205).

As the temperature information is obtained in accordance with the flowcharts of FIGS. 1 and 2 as described above, the previous status of the ink-jet printing apparatus before an interruption of the power is determined based on the flag indicating the elapsed time since the beginning of the undriven status before the interruption, even if the power is interrupted, and the stored temperature information or the newly measured temperature information is selected as temperature information to be used.

Accordingly, in the conventional case where the power of the ink-jet printing apparatus is turned off and then immediately turned on, the temperature information is newly obtained. This arrangement prevents unstable discharge and resulting degradation of printing quality due to printhead driving based on increased temperature.

Further, in a case where no temperature information is stored, it is preferable that the temperature information is obtained regardless of the flowcharts of FIGS. 1 and 2. Further, upon driving of the printhead based on the stored temperature information, further correction computation may be performed. For example, it may be arranged such that when the temperature information is not newly obtained but the stored temperature information is used, the current temperature is determined by using e.g. a table for correction of temperature fall from the difference between the time at which the value was stored and the time at which the temperature information is used. In this case, upon printhead driving, drive control can be made based on further precise environmental temperature.

[Other Embodiments]

In the above embodiment, an example in which it is determined that the ink-jet printing apparatus has went into an undriven status where it does not perform printing, when the printhead is capped, and the period during the first timer continues counting after the beginning of the undriven status is set to be a period in which the flag is not turned ON, as the temperature is kept high is described.

However, in the apparatus in which the temperature falls in some extent during the period from the finish of an actual driving till the finish of the capping operation, the period for the first timer may be set shorter, or the period for the first timer may be omitted and the flag may be turned ON in response to the capping operation. Further, the flag may be turned ON irrespective of the capping operation if a predetermined period has been elapsed since an actual driving has been finished.

In these cases, if the power of the apparatus is turned off during the temperature is high (such as before the capping), the flag is still OFF and accurate temperature information may be obtained in accordance with the sequence shown in the FIG. 2 after the power supply is turned on again, as the previous status before the power is turned off is maintained.

Further, in each of the arrangements described above, the flag is turned ON when it is determined that the temperature information should be obtained, the flag setting may be reversed as being turned OFF when it is determined that the temperature information should be obtained.

Note that in the above embodiment, the ink-jet printing apparatus is an ink-jet printer employing a serial printing method of scanning a carriage carrying a printhead on a recording medium, however, the present invention is applicable to other types of ink-jet printers such as a full-line type printer.

Further, in the above embodiment, the obtained temperature information (environmental temperature) is used in printhead drive (discharge) control, however, the temperature information may be used in control of printhead discharge recovery operation and the like.

Each of the embodiment described above has exemplified a printer, which comprises means (e.g., an electrothermal transducer, laser beam generator, and the like) for generating heat energy as energy utilized upon execution of ink discharge, and causes a change in state of ink by the heat energy. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to print information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum recording medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiments, which can be electrically connected to other apparatus main unit and can receive ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means and the like to the above-described construction of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multicolor mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a recording medium, or the like, is applicable to the present invention. In this case, an ink may be situated opposite electrothermal transducers while being held in liquid or solid state in recess portions of a porous sheet or through holes, as described in Japanese Patent Laid-Open No. 54-56847 or 60-71260. In the present invention, the above-mentioned film boiling system is most effective for the above-mentioned inks.

The present invention can be applied to a system comprising a plurality of devices (e.g., a host computer, an interface, a reader and a printer) or to an apparatus comprising a single device (e.g., a copy machine or a facsimile apparatus).

Further, the object of the present invention can be also achieved by providing a storage medium holding software program code for performing the aforesaid processes to a system or an apparatus (e.g., a personal computer), reading the program code by a CPU or MPU of the system or apparatus, from the storage medium, then executing the program.

In this case, the program code read from the storage medium realizes the functions according to the embodiments, and the storage medium holding the program code constitutes the invention.

Further, the storage medium, such as a floppy disk, a hard disk, an optical disk, a magneto-optical disk, a CD-ROM, a CD-R, a DVD, a magnetic tape, a non-volatile type memory card, and ROM can be used for providing the program code.

Furthermore, besides aforesaid functions according to the above embodiments are realized by executing the program code which is read by a computer, the present invention includes a case where an OS (operating system) or the like working on the computer performs a part or entire processing in accordance with designations of the program code and realizes functions according to the above embodiments.

Furthermore, the present invention also includes a case where, after the program code read from the storage medium is written in a function expansion card which is inserted into the computer or in a memory provided in a function expansion unit which is connected to the computer, a CPU or the like contained in the function expansion card or unit performs a part or entire processing in accordance with designations of the program code and realizes the functions of the above embodiment.

If the present invention is realized as a storage medium, program code corresponding to the above-mentioned flowcharts (FIG. 1 and/or FIG. 2) is to be stored in the storage medium.

As many apparently widely different embodiments of the present invention can be made without departing from the spirit and scope thereof, it is to be understood that the invention is not limited to the specific embodiments thereof except as defined in the appended claims.

What is claimed is:

1. An ink-jet printing apparatus that performs printing on a recording medium by using an ink-jet printhead that performs printing by discharging ink, said apparatus comprising:

a temperature detection device that outputs a signal in correspondence with a temperature;

temperature information acquisition means for obtaining temperature information based on the signal outputted from said temperature detection device;

non-volatile storage means for storing the temperature information obtained by said temperature information acquisition means;

flag setting means for setting a flag indicating whether acquisition of the temperature information is necessary or not; and control means for checking a status of the flag after the power of said apparatus is turned on, and for controlling the acquisition of the temperature information in accordance with the status of the flag.

2. The ink-jet printing apparatus according to claim 1, wherein if a predetermined period of time elapses after the beginning of a state in which said printing apparatus does not perform printing, said flag setting means sets a flag indicating that the acquisition of the temperature information is necessary.

3. The ink-jet printing apparatus according to claim 1, wherein if a first period of time elapses after the beginning of a state in which said printing apparatus does not perform printing, said flag setting means sets a flag indicating that the acquisition of the temperature information is necessary, and if a second period of time, which is longer than the first period of time, elapses after the beginning of the state in which said printing apparatus does not perform printing, said control means performs a control operation to obtain the temperature information.

4. The ink-jet printing apparatus according to claim 2, wherein if the printhead is capped, said flag setting means determines that said printing apparatus is in the state in which said apparatus does not perform printing.

5. The ink-jet printing apparatus according to claim 1, wherein said temperature information acquisition means obtains an environmental temperature by predetermined computation based on the signal outputted from said temperature detection device.

6. The ink-jet printing apparatus according to claim 5, wherein said temperature information acquisition means uses a correction value for the signal outputted from said temperature detection device in the predetermined computation.

7. The ink-jet printing apparatus according to claim 6, wherein the correction value is obtained from a profile of the signal outputted from said temperature detection device.

8. The ink-jet printing apparatus according to claim 1, wherein if the temperature information is not stored in said storage means, said control means performs a control operation to obtain the temperature information.

9. The ink-jet printing apparatus according to claim 1, wherein said temperature detection device is provided in a main body of said printing apparatus.

10. The ink-jet printing apparatus according to claim 1, wherein said temperature detection device is provided in the printhead.

11. The ink-jet printing apparatus according to claim 1, wherein said temperature detection device is a thermistor.

12. The ink-jet printing apparatus according to claim 1, wherein the printhead discharges the ink by utilizing thermal energy, and the printhead includes thermal energy transducers for generating the thermal energy to be applied to the ink.

13. A printhead control method in an ink-jet printing apparatus that has a temperature detection device to output a signal in correspondence with a temperature and that performs printing on a recording medium by using an ink-jet printhead that performs printing by discharging ink, said method comprising:

a temperature information acquisition step of obtaining temperature information based on the signal outputted from the temperature detection device;

a storage step of storing the temperature information obtained in said temperature information acquisition step;

a flag setting step of setting a flag indicating whether acquisition of the temperature information is necessary or not; and a control step of checking a status of the flag after the power of the apparatus is turned on, and controlling the acquisition of the temperature information in accordance with the status of the flag.

14. The printhead control method according to claim 13, wherein in said flag setting step, if a predetermined period of time elapses after the beginning of a state in which the printing apparatus does not perform printing, a flag indicating that the acquisition of the temperature information is necessary is set.

15. The printhead control method according to claim 13, wherein in said flag setting step, if a first period of time elapses after the beginning of a state in which the printing apparatus does not perform printing, a flag indicating that the acquisition of the temperature information is necessary is set, and in said control step, if a second period of time elapses after the beginning of the state in which the printing apparatus does not perform printing, a control operation to obtain the temperature information is performed.

16. The printhead control method according to claim 14, wherein in said flag setting step, if the printhead is capped, it is determined that the printing apparatus is in the state in which the apparatus does not perform printing.

17. The printhead control method according to claim 13, wherein in said temperature information acquisition step, an environmental temperature is obtained by predetermined computation based on the signal outputted from the temperature detection device.

18. The printhead control method according to claim 17, wherein in said temperature information acquisition step, a correction value for the signal outputted from the temperature detection device is used in the predetermined computation.

19. The printhead control method according to claim 18, wherein the correction value is obtained from a profile of the signal outputted from the temperature detection device.

20. The printhead control method according to claim 13, wherein if the temperature information is not stored in said storage step, the temperature information is obtained in said control step.

* * * * *